US009460586B2

(12) United States Patent
Montenegro

(10) Patent No.: US 9,460,586 B2
(45) Date of Patent: Oct. 4, 2016

(54) METHOD OF GAMING, A GAMING SYSTEM AND A GAME CONTROLLER

(71) Applicant: Aristocrat Technologies Australia Pty Limited, North Ryde (AU)

(72) Inventor: Daniel Julio Montenegro, Endeavour Hills (AU)

(73) Assignee: ARISTOCRAT TECHNOLOGIES AUSTRALIA PTY LIMITED, North Ryde (AU)

( * ) Notice: Subject to any disclaimer, the term of this patent is extended or adjusted under 35 U.S.C. 154(b) by 799 days.

(21) Appl. No.: 13/724,694

(22) Filed: Dec. 21, 2012

(65) Prior Publication Data

US 2013/0244750 A1 Sep. 19, 2013

Related U.S. Application Data

(63) Continuation of application No. 13/094,579, filed on Apr. 26, 2011, now abandoned.

(30) Foreign Application Priority Data

Apr. 27, 2010 (AU) ..... 2010901764

(51) Int. Cl.
*G07F 17/34* (2006.01)

(52) U.S. Cl.
CPC ..... *G07F 17/34* (2013.01)

(58) Field of Classification Search
USPC ..... 463/19, 20, 21, 25
See application file for complete search history.

(56) References Cited

U.S. PATENT DOCUMENTS

| | | | | |
|---|---|---|---|---|
| 6,893,342 | B1 * | 5/2005 | Singer et al. | 463/20 |
| 2007/0187693 | A1 | 8/2007 | Brown | |
| 2008/0064477 | A1 * | 3/2008 | Fong et al. | 463/20 |
| 2008/0076521 | A1 | 3/2008 | Little | |

(Continued)

FOREIGN PATENT DOCUMENTS

| | | |
|---|---|---|
| AU | 2004224937 | 5/2005 |
| AU | 2004298286 | 6/2005 |

(Continued)

OTHER PUBLICATIONS

United States Patent and Trademark Office, "Office Action", issued in connection with U.S. Appl. No. 13/094,579, dated Jun. 25, 2012 (19 pages).

*Primary Examiner* — Paul A D'Agostino
*Assistant Examiner* — Brandon Gray
(74) *Attorney, Agent, or Firm* — Armstrong Teasdale LLP

(57) ABSTRACT

Certain examples provide systems, methods, and articles of manufacture for gaming. An example method includes displaying columns of symbol display positions, at least some of the columns having differing numbers of symbol display positions; defining winning combinations of symbol display positions having at least one symbol display position from each of said columns; facilitating selection of at least one of said columns by a player for selection of winning combinations to be played in a game, the selected winning combinations to be played comprising all possible winning combinations derivable from all symbol display positions of said selected at least one column and a designated symbol display position from each of said columns which the player did not select; selecting symbols for display in said symbol display positions; and determining a game outcome based on symbols displayed in said selected winning combinations.

23 Claims, 7 Drawing Sheets

(56) References Cited

U.S. PATENT DOCUMENTS

| | | | | |
|---|---|---|---|---|
| 2008/0128542 | A1 | 6/2008 | Majima | |
| 2008/0182653 | A1 | 7/2008 | O'Halloran | |
| 2009/0117980 | A1 | 5/2009 | Yoshizawa | |
| 2009/0117988 | A1 | 5/2009 | Mathis | |
| 2009/0131161 | A1 | 5/2009 | Lim | |
| 2011/0223984 | A1* | 9/2011 | Mizue | 463/20 |
| 2012/0088566 | A1 | 4/2012 | Montenegro | |

FOREIGN PATENT DOCUMENTS

| | | | |
|---|---|---|---|
| AU | 2005232302 | | 8/2006 |
| AU | 2006201690 | | 11/2006 |
| AU | 2006202976 | | 2/2007 |
| AU | 2008249533 | | 12/2008 |
| CN | 101024614 | | 8/2007 |
| CN | 101251959 | | 8/2008 |
| CN | 101298042 | | 11/2008 |
| CN | 201161106 | | 12/2008 |
| CN | 101495766 | | 7/2009 |
| JP | 2003-06281 | A † | 3/2003 |
| JP | 2006334312 | | 12/2006 |
| JP | 2007125062 | | 5/2007 |
| JP | 2007190079 | | 8/2007 |
| JP | 2007209429 | | 8/2007 |
| JP | 2007260115 | | 10/2007 |
| JP | 2007312886 | | 12/2007 |
| JP | 2008029726 | | 2/2008 |
| JP | 2008029727 | | 2/2008 |
| JP | 2008043694 | | 2/2008 |
| JP | 2008077489 | | 4/2008 |
| JP | 2008086530 | | 4/2008 |
| JP | 2008194197 | | 8/2008 |
| JP | 2008220740 | | 9/2008 |
| JP | 2008279053 | | 11/2008 |
| JP | 2009131308 | | 6/2009 |
| RU | 2360085 | | 6/2009 |
| WO | 2005058444 | | 6/2005 |
| WO | 2008151012 | | 12/2008 |
| WO | 2008157837 | | 12/2008 |
| WO | 2009001290 | | 12/2008 |

* cited by examiner
† cited by third party

METHOD OF GAMING, A GAMING SYSTEM AND A GAME CONTROLLER

CROSS REFERENCE TO RELATED APPLICATIONS

The present application relates to and claims the benefit of priority from U.S. patent application Ser. No. 13/094,579, filed on Apr. 26, 2011, and Australian Provisional Patent Application Number 2010901764, filed on Apr. 27, 2010, which are herein incorporated by reference in their entireties.

FIELD

The present invention relates to a method of gaming, a gaming system and a game controller.

BACKGROUND

It is known to provide a gaming system that randomly selects symbols for display in symbol display positions and determines game outcomes based on the displayed symbols. Some known gaming systems also include winning combinations of designated symbol display positions. In this case, these gaming systems determine game outcomes based on the symbols displayed in the winning combinations.

While such gaming systems provide players with enjoyment, a need exists for alternative gaming systems in order to maintain or increase player enjoyment.

SUMMARY

In a first aspect, the present invention provides a method of gaming including:

displaying columns of symbol display positions, at least some of the columns having differing numbers of symbol display positions;

defining winning combinations of symbol display positions having at least one symbol display position from each of said columns;

facilitating selection of at least one of said columns by a player for selection of winning combinations to be played in a game, the selected winning combinations to be played including all possible winning combinations derivable from all symbol display positions of said selected at least one column and a designated symbol display position from each of said columns which the player did not select;

selecting symbols for display in said symbol display positions; and determining a game outcome based on the symbols displayed in said selected winning combinations.

In an embodiment, the method includes displaying five columns of symbol display positions. In an arrangement, the method further includes displaying first and last columns having four symbol display positions, second and second last columns having three symbol display positions and a central column having two symbol display positions.

In an embodiment, the method includes displaying symbol display positions as a plurality of reels corresponding to the columns.

In an embodiment, the method includes displaying non-uniform size symbol display positions. In an arrangement, the method includes displaying symbol display positions having one size in one of the columns and another size in another one of the columns. In another arrangement, the symbol display position size in one of the columns is based on a number of symbol display positions in this column.

In an embodiment, the winning combinations include win lines.

In a second aspect, the invention provides a gaming system including:

a display including columns of symbol display positions, at least some of the columns having differing numbers of symbol display positions;

a winning combination module arranged to define winning combinations of symbol display positions having at least one symbol display position from each of said columns;

a winning combination selector arranged to facilitate selection of at least one of said columns by a player for selection of winning combinations to be played in a game, the selected winning combinations to be played including all possible winning combinations derivable from all symbol display positions of said selected at least one column and a designated symbol display position from each of said columns which the player did not select;

a symbol selector arranged to select symbols for display in said symbol display positions; and an outcome determiner arranged to determine a game outcome based on symbols displayed in said selected winning combinations.

In a third aspect, the invention provides a game controller including:

a winning combination module arranged to define winning combinations of symbol display positions having at least one symbol display position from each one of a plurality of columns of symbol display positions, at least some of the plurality of columns having differing numbers of symbol display positions;

a winning combination selector arranged to facilitate selection of at least one of said columns by a player for selection of winning combinations to be played in a game, the selected winning combinations to be played including all possible winning combinations derivable from all symbol display positions of said selected at least one column and a designated symbol display position from each of said columns which the player did not select;

a symbol selector arranged to select symbols for display in said symbol display positions; and an outcome determiner arranged to determine a game outcome based on symbols displayed in said selected winning combinations.

In a fourth aspect, the invention provides a gaming system including:

at least one gaming device including a cabinet, a display including columns of symbol display positions, the display mounted within the cabinet, a game play mechanism mounted to the cabinet incorporating at least one input device, the game play mechanism operable by a player to place wagers in a game, and a game controller disposed within the cabinet including a processor and a memory storing game control instructions which enable the game controller to operate, the game controller including:

a winning combination module arranged to define winning combinations of symbol display positions having at least one symbol display position from each of said columns, at least some of the columns having differing numbers of symbol display positions;

a winning combination selector arranged to facilitate selection of at least one of said columns by the player for selection of winning combinations to be played in the game, the selected winning combinations to be played including all possible winning combinations derivable from all symbol display positions of said selected at least one column and a designated symbol display position from each of said columns which the player did not select;

a symbol selector arranged to select symbols for display in said symbol display positions; and an outcome determiner arranged to determine a game outcome based on symbols displayed in said selected winning combinations.

In a fifth aspect, the invention provides computer program code which when executed implements the above method.

In a sixth aspect, the invention provides a computer readable medium including the above program code.

In a seventh aspect, the invention extends to transmitting or receiving the above program code.

In an eighth aspect, the invention provides a data signal including the above program code.

BRIEF DESCRIPTION OF DRAWINGS

Certain exemplary embodiments will now be described with reference to the accompanying drawings in which.

Figure 1:
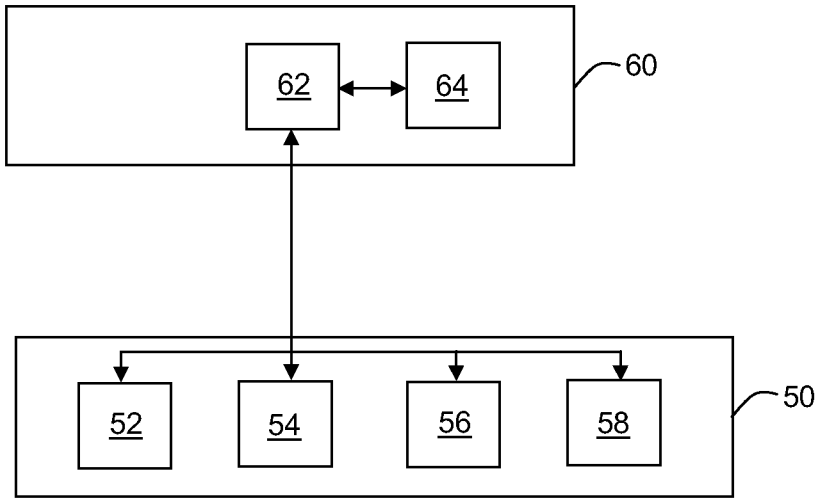
FIG. 1 is a block diagram of the core components of a gaming system.

The foregoing summary, as well as the following detailed description of certain embodiments of the present invention, will be better understood when read in conjunction with the drawings. For the purpose of illustrating the invention, certain embodiments are shown in the drawings. It should be understood, however, that the present invention is not limited to the arrangements and instrumentality shown in the attached drawings.

DETAILED DESCRIPTION

Although the following discloses example methods, systems, articles of manufacture, and apparatus including, among other components, software executed on hardware, it should be noted that such methods and apparatus are merely illustrative and should not be considered as limiting. For example, it is contemplated that any or all of these hardware and software components could be embodied exclusively in hardware, exclusively in software, exclusively in firmware, or in any combination of hardware, software, and/or firmware. Accordingly, while the following describes example methods, systems, articles of manufacture, and apparatus, the examples provided are not the only way to implement such methods, systems, articles of manufacture, and apparatus.

When any of the appended claims are read to cover a purely software and/or firmware implementation, at least one of the elements in an at least one example is hereby expressly defined to include a tangible medium such as a memory, DVD, CD, Blu-ray, etc. storing the software and/or firmware.

Referring to the drawings, there is shown a method and a gaming system for implementing the method. In the embodiment, the method includes displaying columns of symbol display positions, whereby at least some of the columns have differing numbers of symbol display positions. In the embodiment, the method also includes defining winning combinations of symbol display positions having at least one symbol display position from each of said columns, and facilitating selection of at least one of the columns by a player for selection of winning combinations to be played in a game. The selected winning combinations to be played include all possible winning combinations derivable from all symbol display positions of the selected column or columns and a designated symbol display position from each of the columns which the player did not select. In the embodiment, the method further includes selecting symbols for display in the symbol display positions and determining a game outcome based on symbols displayed in the selected winning combinations.

General Construction of Gaming System

The gaming system can take a number of different forms. In a first form, a stand alone gaming machine is provided wherein all or most components to implement the game are present in a player operable gaming machine.

In a second form, a distributed architecture is provided wherein some of the components to implement the game are present in a player operable gaming machine and some of the components to implement the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system has several core components. At the broadest level, the core components are a player interface 50 and a game controller 60 as illustrated in FIG. 1. The player interface is arranged to enable manual interaction between a player and the gaming system and for this purpose includes the input/output components for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server.

Figure 2:
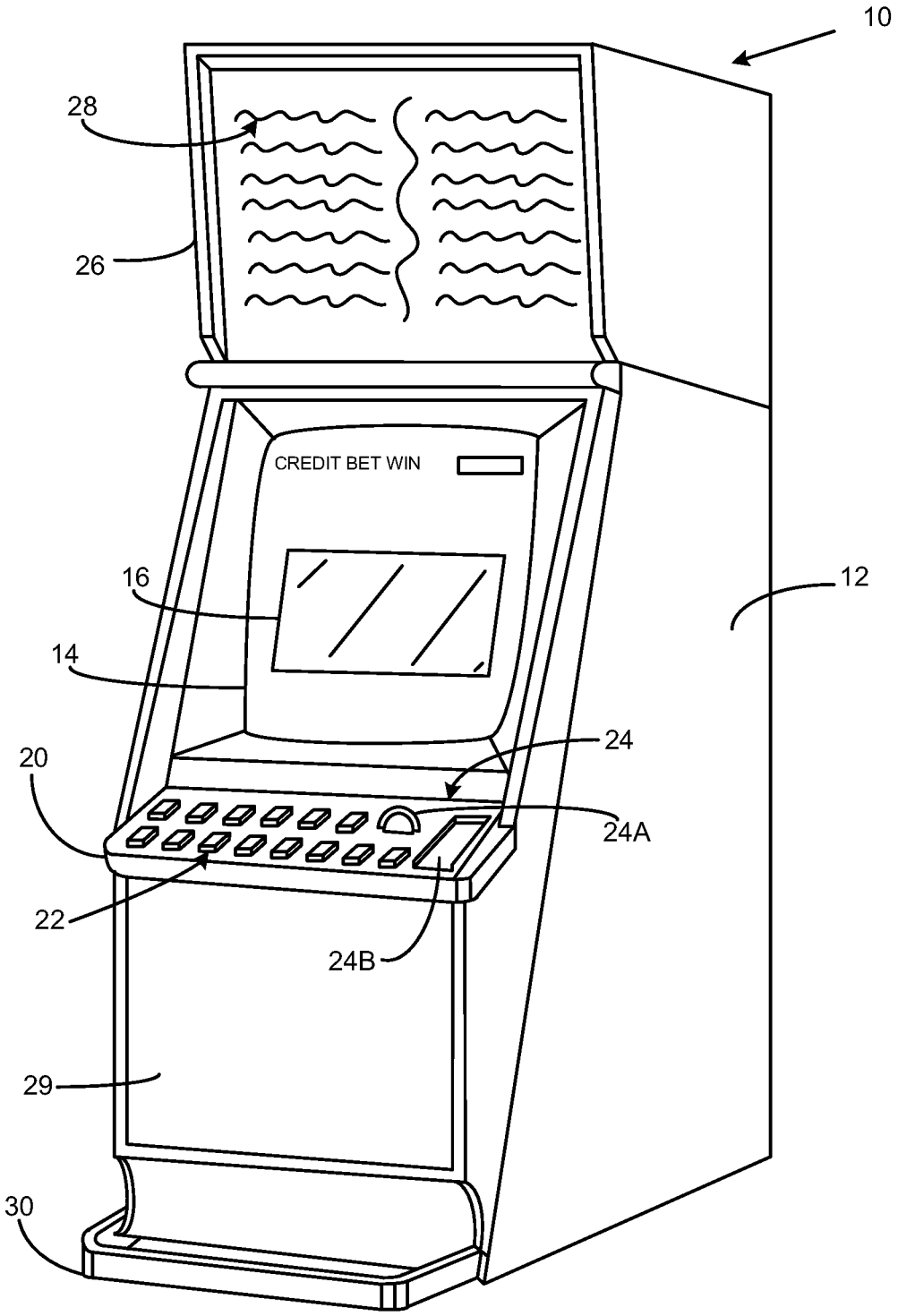
FIG. 2 is a perspective view of a stand alone gaming machine.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may configure for ticket in such that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
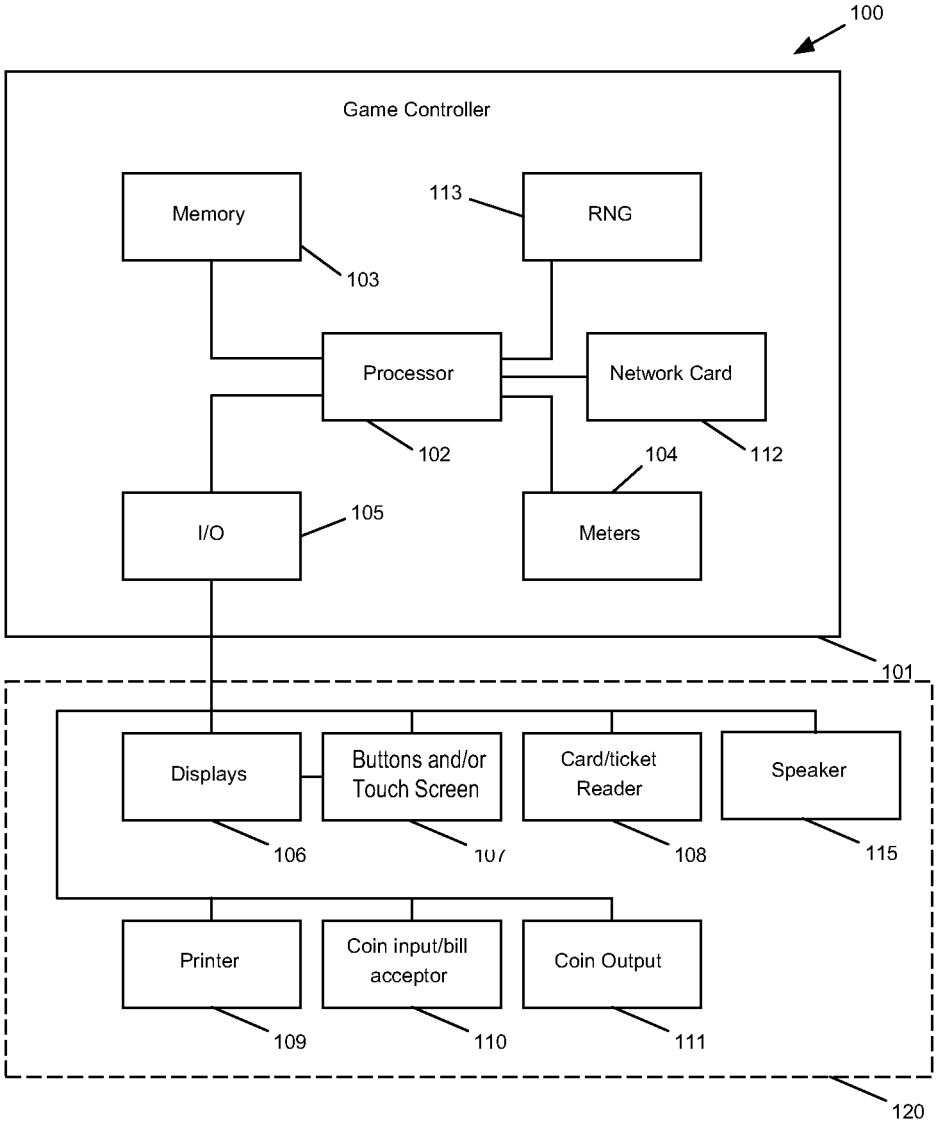
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted based on the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
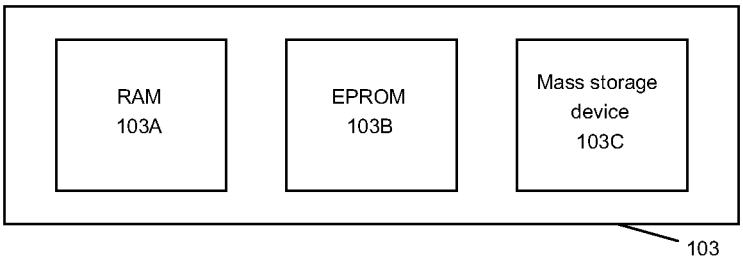
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
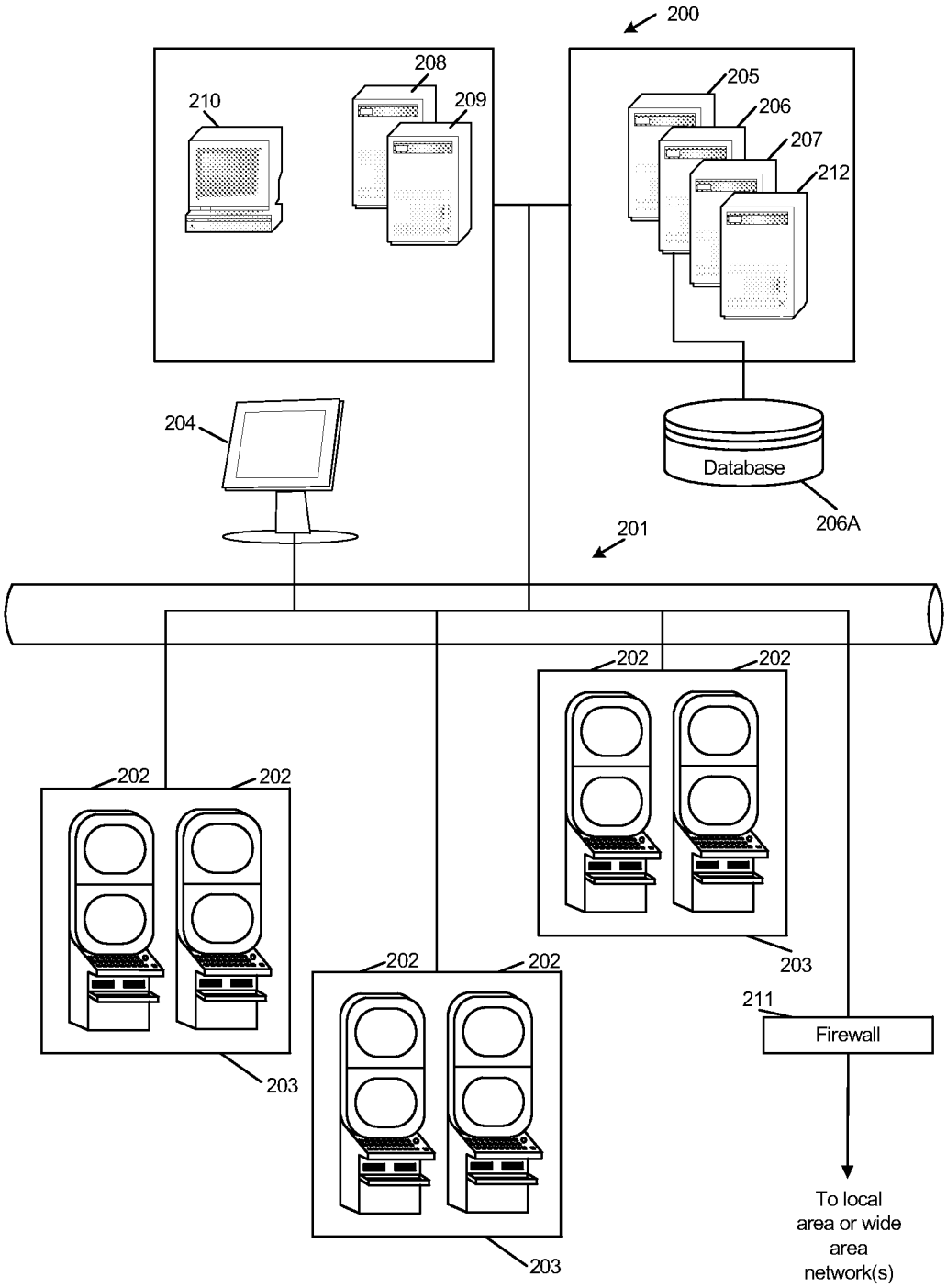
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the rules, requirements, guidelines, and/or preferences for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games based on the terminals.

Further Detail of Gaming System

In an embodiment, a player operates the game play mechanism 56 to input instructions (e.g. make selections) for a game. The inputted instructions, and wager, are then used in the game to affect a game outcome.

For example, a player makes a selection of columns, from a display of columns of symbol display positions, for use in selecting winning combinations to be played in the game. The winning combinations are defined as having at least one symbol display position from each of the columns. In an embodiment, the winning combinations include win lines which will be referred to hereafter.

In another embodiment, the columns of symbol display positions correspond to reels of symbols displayed in the symbol display positions. In an example, the player obtains a win entitlement in a game outcome based on a selection of a number of reels to play and an amount to wager per reel. The selection of a reel means that each displayed symbol of the reel can be substituted for another symbol displayed in that reel. In other words, all symbols displayed at symbol display positions corresponding to a selected reel can be used to derive winning combinations including win lines with symbols displayed at designated symbol display positions of the other reels which the player did not select. For example, if there are five reels having 4, 3, 2, 3 and 4 symbol display positions respectively, and only the first reel is selected, four winning combinations of symbol display positions constituting four ways to win (e.g. win lines) can be derived. In this example, each winning combination includes any one of the symbols displayed in the four symbol display positions of the first reel and one displayed symbol in a designated symbol display position in each of the second, third, fourth and fifth reels which were not selected.

The total number of ways to win on win lines to be played in the game is thus determined by multiplying the number of active symbol display positions of each reel, the active symbol display positions being all symbol display positions of each selected reel, with the designated symbol display position of the non-selected reels. Also, in the embodiment, at least some of the columns (e.g. reels) have differing numbers of symbol display positions. Thus, in the above example where there are five reels having 4, 3, 2, 3 and 4 symbol display positions respectively, if all the reels are selected to form win lines, the total number of ways to win is 288 (i.e. 4*3*2*3*4).

It will be appreciated by those persons skilled in the art that the designation of symbol display positions (e.g. number of symbol display positions or size of symbol display positions) in each column (e.g. reel) may be specified in game rules 642 or may be designated at random. For example, it may be specified that adjacent designated symbol display positions in non-selected reels are aligned horizontally on the display.

Figure 6:
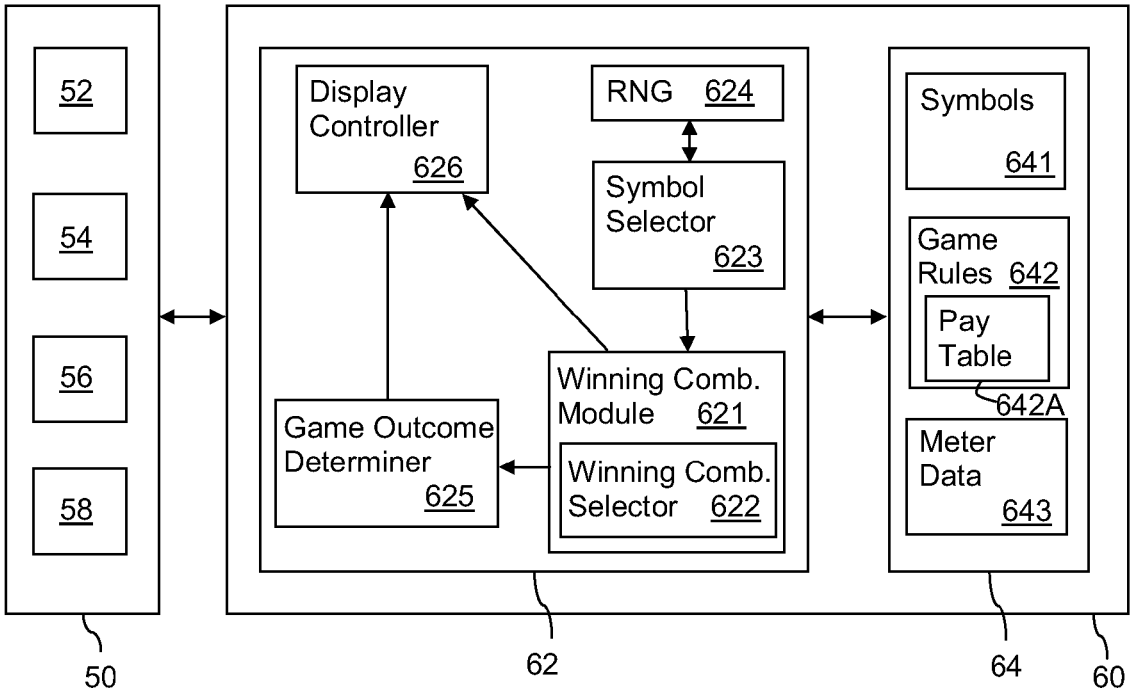
FIG. 6 is a further block diagram of a gaming system.

As described above, symbols are selected for display in the symbol display positions and a game outcome (e.g. a win entitlement) is determined based on symbols displayed in the selected win lines. In FIG. 6, the processor 62 of game controller 60 is shown implementing a number of modules based on program code and data stored in memory 64 to conduct the game. The modules are adapted to display the symbol display positions in columns, facilitate selection of reels for selection of win lines to be played in the game, select symbols for display in the symbol display positions and determine a game outcome based on the symbols displayed in the played win lines. Persons skilled in the art will appreciate that several of the modules could be implemented in some other way, for example by a dedicated circuit, or on a server remote from the game controller 60.

In the embodiment shown in FIG. 6, the modules of the game controller 60 include a winning combination module 621 to define all possible win lines for each variation of display of reels and symbol display positions. For example, in the above five reel 4*3*2*3*4 symbol display position example, the winning combination module 621 determines that there are 288 possible win lines which can be played if a player selects all reels. In another example, there are four reels of 4, 3, 2 and 3 symbol display positions respectively. In this case, the winning combination module 621 would determine that there are 72 possible win lines to be played in the game.

The winning combination module 621 also includes a winning combination selector 622, which operates in response to the player's operation of game play mechanism 56 to select the reels for selection of win lines to be played in the game. For example, the player may select reels 1 to 4 of the five reel 4*3*2*3*4 symbol display position example and thus the winning combination module 621 determines that there are 72 win lines to be played in the game.

In an example, the game is a spinning reel type game where the player operates the game play mechanism 56 to input a wager and selects a number of reels to select a number of win lines to be played in each game. In response, a game outcome is generated by the winning combination module 621 communicating with a symbol selector 623 which selects symbols from a set of symbols specified by symbol data 641 using random number generator 624. The selected symbols are advised to the display controller 626 which causes them to be displayed on display 54 at designated symbol display positions. The symbols 641 for the game may be displayed in symbol display positions arranged in columns, generally representing reels. In an example, the symbol selector 623 selects symbols from a plurality of symbol sets stored corresponding to respective ones of a plurality of spinning reels.

The display controller 626 is advised of the selected symbols and displays them in symbol display positions such that a player selected win line includes one symbol display position and thus one symbol from each column. A game outcome determiner 625 then determines an outcome of the game based on the symbols selected for display in the played win lines. The result of the determination (e.g. whether the player is entitled to a prize) is then advised to the display controller 626 for display to the player on the display 54.

Figure 8A:
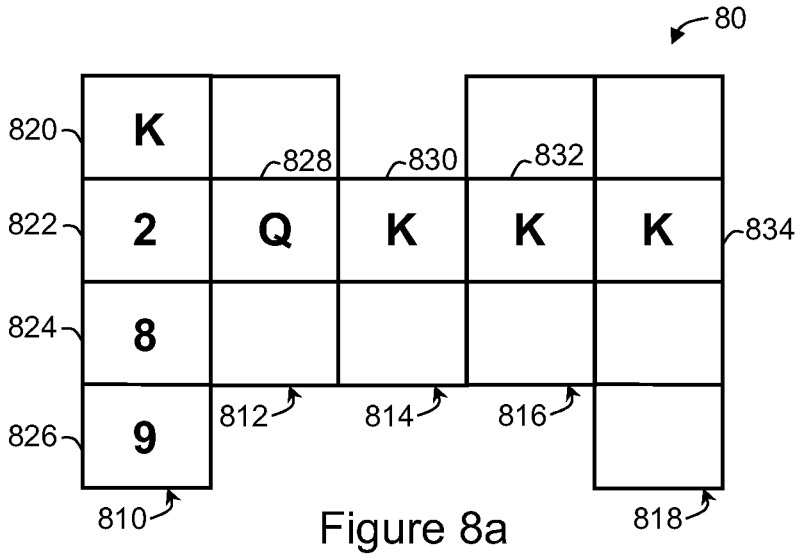
FIGS. 8*a* and 8*b* show exemplary displays of an example of an embodiment.

An example of a game employing the above method is described with reference to FIGS. 8*a* and 8*b*. The example 800 shown in FIG. 8*a* illustrates a display with the first reel 810 selected by the player for selection of win lines to be played. In the example 800, the winning combination selector 622 operated in response to the player's operation of the game play mechanism 56 to select the first reel for selection of win lines to be played in the game. The winning combination module 621 thus defined the win lines to be played as having at least one symbol display position 820 822 824 826 from reel 810 and a designated symbol display position from each of reels 812 814 816 818 which the player did not select. That is, the winning combination module 621 defined four win lines to be played in the game out of a possible 288.

| Symbol Display Positions |
|---|
| Win line 1: 820 828 830 832 834 |
| Win line 2: 822 828 830 832 834 |
| Win line 3: 824 828 830 832 834 |
| Win line 4: 826 828 830 832 834 |

It will be appreciated by those skilled in the art that the designated symbol display positions from each of reels 812 814 816 818 need not be located in a row. In addition, the designation of symbol display positions to form a win line may be specified in game rules 642 or may be designated at random.

In the example 800, the symbol selector 623 selected symbols which were subsequently advised to the display controller 626 for display in the corresponding symbol display positions from the symbols specified by symbol data 641 using the random number generator 624. It can be seen from the example 800 that the game outcome determiner 625 would not determine that a winning combination of symbols was displayed in any of the played win lines.

| | Symbols | | | |
|---|---|---|---|---|
| Win line 1: K | Q | K | K | K |
| Win line 2: 2 | Q | K | K | K |
| Win line 3: 8 | Q | K | K | K |
| Win line 4: 9 | Q | K | K | K |

Figure 8B:
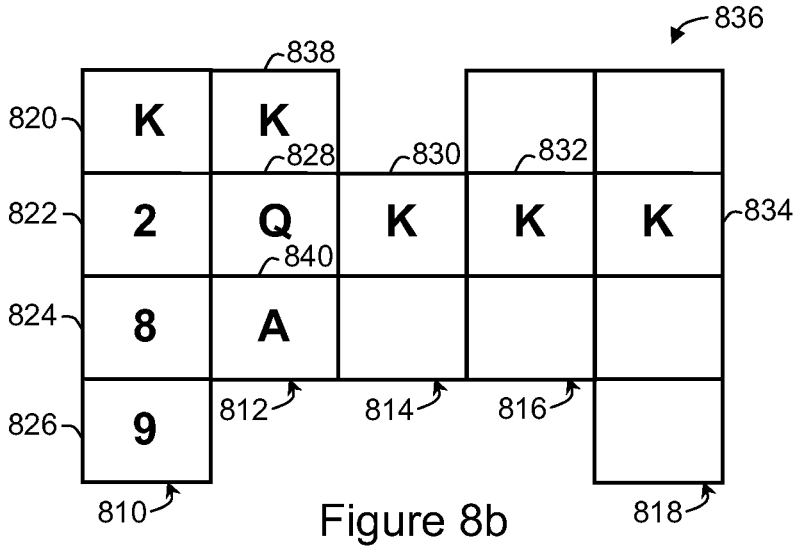

FIG. 8*b* shows an example 836 where both the first reel 810 and second reel 812 are selected by the player for the selection of win lines to be played in the game. That is, the winning combination selector 622 operated in response to the player's operation of the game play mechanism 56 to select both the first and second reels. In this case, the winning combination module 621 defined twelve win lines to be played out of a possible 288.

In the example 836, the symbol selector 623 selected symbols which were advised to the display controller 626 for display in the symbol display positions. In this case, the game outcome determiner 625 determines that a winning combination of symbols (5 Kings) was displayed in one of the played win lines (Win line 1).

| | Symbols | | | |
|---|---|---|---|---|
| Win line 1: K | K | K | K | K |
| Win line 2: K | Q | K | K | K |
| Win line 3: K | A | K | K | K |
| Win line 4: 2 | K | K | K | K |
| Win line 5: 2 | Q | K | K | K |
| Win line 6: 2 | A | K | K | K |
| Win line 7: 8 | K | K | K | K |
| Win line 8: 8 | Q | K | K | K |
| Win line 9: 8 | A | K | K | K |
| Win line 10: 9 | K | K | K | K |
| Win line 11: 9 | Q | K | K | K |
| Win line 12: 9 | A | K | K | K |

Another example of a game employing the above method is described with reference to FIGS. 9*a* and 9*b*. The example 842 shown in FIG. 9*a* also illustrates a display with the five reels 810 812 814 816 818 however the reels and symbol display positions are of non-uniform size. It will be appreciated by those skilled in the art that either the reels or the symbol display positions could be displayed in non-uniform sizes. It will also be appreciated that the size of the symbol display positions and/or the reels may be specified in game rules 642 or may be designated at random.

In the example 842, the reels 810 812 814 816 818 have symbol display positions in different sizes and the size of the symbol display positions in one reel corresponds to the number of symbol display positions in the reel. In the example 842, the central reel 814 with two symbol display positions displays larger sized symbol display positions than the second and penultimate reels 812 816 who, in turn, displays larger sized symbol display positions than the first and last reels 810 818. It is envisaged however that a different relationship between the number of symbol display positions in a reel and the symbol display position size may be employed, such as the inverse of the above relationship.

In the example 842, all the reels 810 812 814 816 818 are selected by the player for selection of win lines to be played. Thus, the winning combination module 621 defined 288 win lines to be played and it can be seen from the example 842 that the game outcome determiner 625 would determine that a winning combination of symbols (5 Kings) was displayed in one of the played win lines.

Figure 9A:
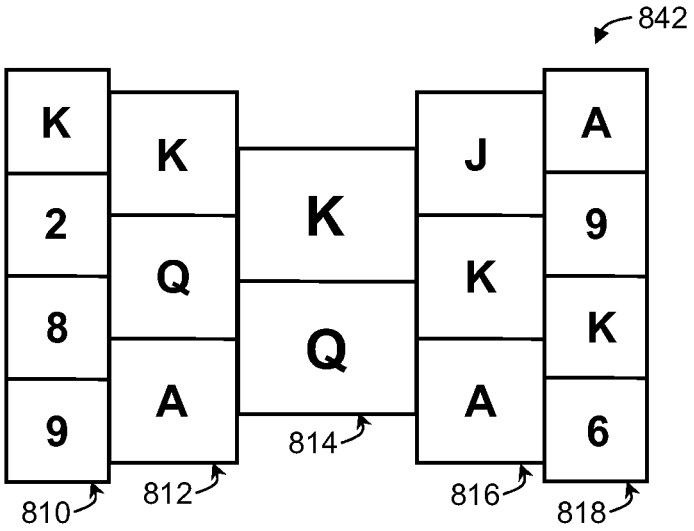
FIGS. 9*a* and 9*b* show exemplary displays of an example of an embodiment.
Figure 9B:
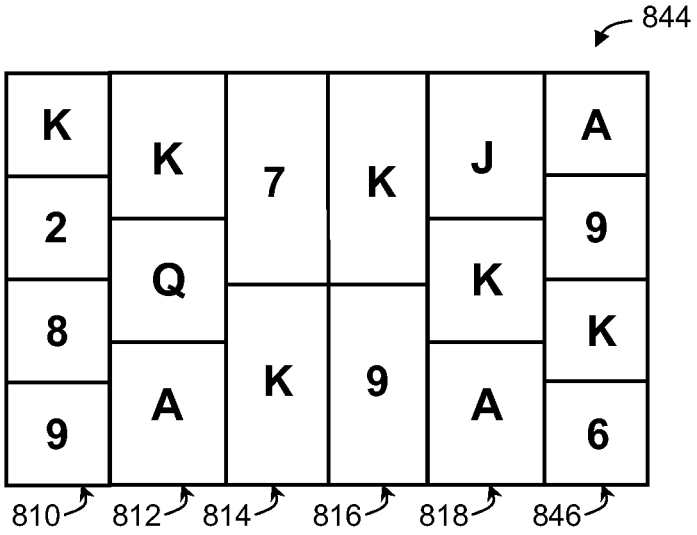

The example 844 shown in FIG. 9*a* also illustrates a display with reels and symbol display positions having non-uniform sizes. In this example, there is a sixth reel 846 and the displayed size of the symbol display positions is such that the top of the first symbol display position and the bottom the last symbol display position of adjacent reels is aligned.

In the example 842, all the reels 810 812 814 816 818 846 are also selected by the player for selection of win lines to be played. In this example, the reels have 4, 3, 2, 2, 3 and 4 symbol display positions respectively thus the winning combination module 621 defined 576 win lines to be played. It can also be seen that the game outcome determiner 625 determined that a winning combination of symbols (6 Kings) was displayed in one of the played win lines.

Figure 7:
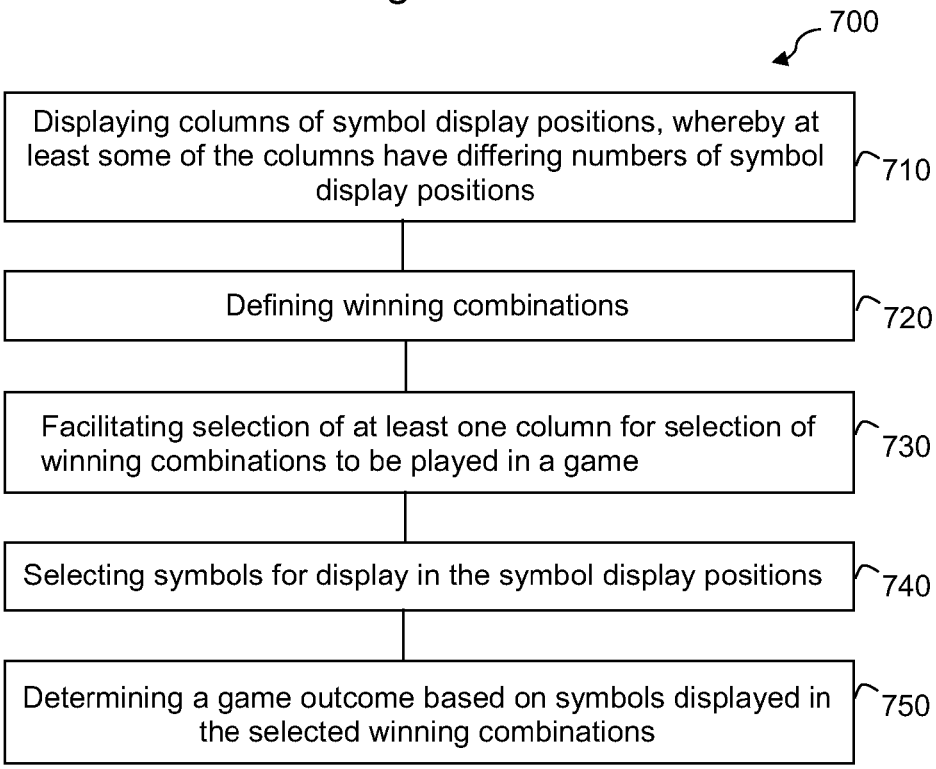
FIG. 7 is a flow chart of a method of an embodiment.

FIG. 7 is a flow diagram representative of example machine readable instructions that can be executed to implement one or more of the example systems shown and described herein and/or portions of one or more of those systems. The example process(es) of FIG. 7 can be performed using a processor, a controller and/or any other suitable processing device, such as the game controller 60 and/or other component of system 10, 100. For example, the example process(es) of FIG. 7 can be implemented using coded instructions (e.g., computer readable instructions) stored on a tangible computer readable medium such as a flash memory, a read-only memory (ROM), and/or a random-access memory (RAM). As used herein, the term tangible computer readable medium is expressly defined to include any type of computer readable storage and to exclude propagating signals. Additionally or alternatively, the example process(es) of FIG. 7 can be implemented using coded instructions (e.g., computer readable instructions) stored on a non-transitory computer readable medium such as a flash memory, a read-only memory (ROM), a random-access memory (RAM), a cache, or any other storage media in which information is stored for any duration (e.g., for extended time periods, permanently, brief instances, for temporarily buffering, and/or for caching of the information). As used herein, the term non-transitory computer readable medium is expressly defined to include any type of computer readable medium and to exclude propagating signals.

Alternatively, some or all of the example process(es) of FIG. 7 can be implemented using any combination(s) of application specific integrated circuit(s) (ASIC(s)), programmable logic device(s) (PLD(s)), field programmable logic device(s) (FPLD(s)), discrete logic, hardware, firmware, etc. Also, some or all of the example process(es) of FIG. 7 can be implemented manually or as any combination (s) of any of the foregoing techniques, for example, any combination of firmware, software, discrete logic and/or hardware. Further, although the example process(es) of FIG. 7 are described with reference to the flow diagram of FIG. 7, other methods of implementing the process(es) of FIG. 7 can be employed. For example, the order of execution of the blocks can be changed, and/or some of the blocks described can be changed, eliminated, sub-divided, or combined. Additionally, any or all of the example process(es) of FIG. 7 can be performed sequentially and/or in parallel by, for example, separate processing threads, processors, devices, discrete logic, circuits, etc.

Referring back to FIG. 7, a method 700 of gaming as described above is summarised. The method 700 includes displaying 710 columns of symbol display positions, whereby at least some of the columns have differing numbers of symbol display positions. The method 700 further includes defining 720 winning combinations (e.g. win lines) of symbol display positions having at least one symbol display position from each of the columns, and facilitating 730 selection of at least one of the columns by a player for selection of winning combinations (e.g. win lines) to be played in a game, the selected winning combinations to be played including all possible winning combinations derivable from all symbol display positions of the selected at least one column and a designated symbol display position from each of the columns which the player did not select. In addition, the method 700 further includes selecting 740 symbols for display in the symbol display positions and determining 750 a game outcome based on symbols displayed in the selected winning combinations.

Further aspects of the method will be apparent from the above description of the system. It will be appreciated that at least part of the method will be implemented digitally by a processor. Persons skilled in the art will also appreciate that the method could be embodied in program code. The program code could be supplied in a number of ways, for example on a tangible computer readable storage medium, such as a disc or a memory (for example, that could replace part of memory 103) or as a data signal (for example, by transmitting it from a server. Persons skilled in the art, will appreciate that program code provides a series of instructions executable by the processor.

It will be understood to persons skilled in the art of the invention that many modifications may be made without departing from the spirit and scope of the invention, in particular it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e., to specify the presence of the stated features but not to preclude the presence or addition of further features in various embodiments of the invention.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A method of gaming comprising:

receiving, by a gameplay mechanism of a gaming system, a wager input by a player to initiate a game, the wager based on a credit balance established by the player using a credit input mechanism;

displaying, by a game controller of the gaming system, a plurality of columns of symbol display positions of the game on a display of the gaming system, at least two columns of the plurality of columns having differing numbers of symbol display positions;

defining, by the game controller, win lines of symbol display positions having at least one symbol display position from each of the plurality of columns based on game rules stored in a storage device of the gaming system;

selecting, by the game controller, at least one column from the plurality of columns displayed on the gaming system in response to the at least one column selected by the player received via the game play mechanism of the gaming system, selecting, by the game controller, a plurality of win lines to be played from the defined win lines and based on the at least one column selected by the player, each selected win line of the plurality of win lines comprising one symbol display position from each selected column and one symbol display position from each remaining column the player did not select, each of the selected win lines comprising a chance for the player to win the game based on symbols displayed;

populating, by the game controller, each of the symbol display positions of the plurality of columns with respective symbols; and determining, by the game controller, an outcome of the game based on symbols displayed in the symbol display positions of the selected win lines.

2. A method as claimed in claim 1, wherein displaying comprises displaying five columns of symbol display positions.

3. A method as claimed in claim 2, further comprising displaying first and last columns having four symbol display positions, second and fourth columns having three symbol display positions and a central column having two symbol display positions.

4. A method as claimed in claim 1, wherein displaying comprises displaying the plurality of columns of symbol display positions as a plurality of reels corresponding to said columns.

5. A method as claimed in claim 1, wherein displaying comprises displaying non-uniform size symbol display positions in at least two columns from among the plurality of columns.

6. A method as claimed in claim 5, wherein displaying comprises displaying symbol display positions having one size in one of said columns and another size in another one of said columns.

7. A method as claimed in claim 6, wherein displaying comprises displaying the symbol display position size based on a number of symbol display positions included in the corresponding column.

8. A gaming system comprising:

a game play mechanism configured to receive a wager input by a player to initiate a game, the wager based on a credit balance established by the player using a credit input mechanism;

a display configured to display a plurality of columns of symbol display positions of a game, at least two columns of the plurality of columns having differing numbers of symbol display positions;

a winning combination module configured to define win lines of symbol display positions having at least one symbol display position from each of the plurality of columns based on game rules stored in a storage device of the gaming system;

a winning combination selector configured to:

select at least one column from the plurality of columns displayed on the display in response to the at least one column selected by the player received via the game play mechanism of the gaming system, and select a plurality of win lines to be played from the defined win lines and based on the at least one column selected by the player, each of the selected win lines comprising one symbol display position from each selected column and one symbol display position from each remaining column the player did not select, each of the selected win lines further comprising a chance for the player to win the game based on symbols displayed;

a symbol selector configured to populate each of the symbol display positions of the plurality of columns with respective symbols; and an outcome determiner configured to determine an outcome of the game based on symbols displayed in the symbol display positions of the selected win lines.

9. A gaming system as claimed in claim 8, wherein said display displays five columns of symbol display positions.

10. A gaming system as claimed in claim 9, wherein said display displays first and last columns having four symbol display positions, second and fourth columns having three symbol display positions and a central column having two symbol display positions.

11. A gaming system as claimed in claim 8, wherein said display displays a plurality of reels corresponding to the plurality of columns.

12. A gaming system as claimed in claim 8, wherein said display displays non-uniform size symbol display positions.

13. A gaming system as claimed in claim 12, wherein said symbol display positions have one size in one of said columns and another size in another of said columns.

14. A gaming system as claimed in claim 13, wherein the symbol display position size of a column is based on a number of symbol display positions in the respective column.

15. A game controller comprising a processor configured to implement:

a game play mechanism configured to receive a wager input by a player to initiate a game, the wager based on a credit balance established by the player using a credit input mechanism;

a winning combination module configured to define win lines of symbol display positions of a game having at least one symbol display position from each column of a plurality of columns of symbol display positions based on game rules stored in a storage device of a gaming system, at least two columns of the plurality of columns having differing numbers of symbol display positions;

a winning combination selector configured to:

select at least one column from the plurality of columns displayed on a display in response to the at least one column selected by the player received via the game play mechanism of the gaming system, and select a plurality of win lines to be played from the defined win lines and based on the at least one column selected by the player, each selected win line of the plurality of win lines comprising one symbol display position from each selected column and one symbol display position from each remaining column the player did not select, each of the selected win lines comprising a chance for the player to win the game based on symbols displayed;

a symbol selector configured to populate each of the symbol display positions of the plurality of columns with respective symbols; and an outcome determiner configured to determine an outcome of the game based on symbols displayed in the symbol display positions of the selected win lines.

16. A game controller as claimed in claim 15, wherein said display displays five columns of symbol display positions.

17. A game controller as claimed in claim 16, wherein said display displays first and last columns having four symbol display positions, second and fourth columns having three symbol display positions and a central column having two symbol display positions.

18. A game controller as claimed in claim 15, wherein said display displays a plurality of reels corresponding to said columns.

19. A game controller as claimed in claim 15, wherein said display displays non-uniform size symbol display positions.

20. A game controller as claimed in claim 19, wherein said symbol display positions have one size in one of said columns and another size in another of said columns.

21. A game controller as claimed in claim 20, wherein the symbol display position size in a column is based on a number of symbol display positions in the respective column.

22. A gaming system comprising:

a cabinet;

a display configured to display a plurality of columns of symbol display positions of a game, the display mounted within the cabinet;

a credit input mechanism mounted to the cabinet;

a game play mechanism mounted to the cabinet, including at least one input device, the game play mechanism configured to receive a wager input by the player to initiate the game, the wager based on a credit balance established by the player using the credit input mechanism; and a game controller disposed within the cabinet and comprising a processor and a non-transitory memory storing game control instructions that enable the game controller to operate, the game controller comprising:

a winning combination module configured to define win lines of symbol display positions having at least one symbol display position from each of the plurality of columns based on game rules stored in the non-transitory memory, at least two columns of the plurality of columns having differing numbers of symbol display positions;

a winning combination selector configured to:

select at least one column from the plurality of columns displayed on the display in response to the at least one column selected by the player received via the game play mechanism, and select a plurality of win lines to be played from the defined win lines and based on the at least one column selected by the player, each selected win line of the plurality of win lines comprising one symbol display position from each selected column and one symbol display position from each remaining column the player did not select, each of the selected win lines further comprising a chance for the player to win the game based on symbols displayed;

a symbol selector configured to populate each of the symbol display positions of the plurality of columns with respective symbols; and an outcome determiner configured to determine an outcome of the game based on symbols displayed in the symbol display positions of the selected win lines.

23. A tangible non-transitory computer readable storage medium comprising computer program code that, when executed, implements a method of gaming, the method comprising:

receiving, by a gameplay mechanism of a gaming system, a wager input by a player to initiate a game, the wager based on a credit balance established by the player using a credit mechanism;

displaying, by a processor of the gaming system, a plurality of columns of symbol display positions of a game on a display of the gaming system, at least two columns of the columns having differing numbers of symbol display positions;

defining, by the processor, win lines of symbol display positions having at least one symbol display position from each of the plurality of columns based on game rules stored in a storage device of the gaming system;

selecting, by the processor, at least one column from the plurality of columns displayed on the gaming system in response to a player selection received via the game play mechanism of the gaming system, selecting, by the processor, a plurality of win lines to be played from the defined win lines and based on the at least one column selected by the player, each selected win line of the plurality of win lines comprising one symbol display position from each selected column and one symbol display position from each remaining column the player did not select, each of the selected win lines further comprising a chance for the player to win the game based on symbols displayed;

populating, by the processor, each of the symbol display positions of the plurality of columns with respective symbols; and determining, by the processor, an outcome of the game based on symbols displayed in the symbol display positions of the selected win lines.

* * * * *